United States Patent [19]

Beymer

[11] Patent Number: 4,787,233

[45] Date of Patent: Nov. 29, 1988

[54] ROLL FORMING MACHINE WITH AUXILIARY ROLL SET ASSEMBLY

[75] Inventor: Glen E. Beymer, Creswell, Oreg.

[73] Assignee: Eastside Machine Company, Creswell, Oreg.

[21] Appl. No.: 87,298

[22] Filed: Aug. 20, 1987

[51] Int. Cl.[4] ..... B21D 5/08

[52] U.S. Cl. ..... 72/181; 72/176; 72/238

[58] Field of Search ..... 72/181, 182, 179, 176, 72/160, 226, 234

[56] References Cited

U.S. PATENT DOCUMENTS

| | | | |
|---|---|---|---|
| 901,637 | 10/1908 | McKenzie | 72/181 |
| 995,604 | 6/1911 | Keagy | 72/181 |
| 1,184,947 | 5/1916 | Hewitt | 72/181 |
| 1,261,735 | 4/1918 | Hunker | 72/181 |
| 1,266,545 | 5/1918 | Anderson | 72/181 |
| 1,736,331 | 11/1929 | Townsend | 72/181 |
| 3,710,607 | 1/1973 | Beymer | 72/30 |
| 3,788,115 | 1/1974 | Beymer | 72/181 |
| 3,791,185 | 2/1974 | Knudson | 72/181 |
| 4,020,666 | 5/1977 | Beymer | 72/177 |
| 4,660,399 | 4/1987 | Suter et al. | 72/181 |

*Primary Examiner*—Daniel C. Crane

*Attorney, Agent, or Firm*—James D. Givnan, Jr.

[57] ABSTRACT

A roll forming machine for the production of metal siding for installation on a building. A metal strip is progressively shaped by upper and lower roll sets spaced along the roll machine to shape the strip edges. An auxiliary roll set assembly is detachably mounted on the roll forming machine frame and includes upper and lower roll sets which shape a central portion of the metal strip. Side plate members of the auxiliary roll set assembly rest on the roll machine frame members with frame cross members assuring alignment of the interchangeable assembly. Fasteners removably couple the assembly to the roll forming machine frame.

1 Claim, 1 Drawing Sheet

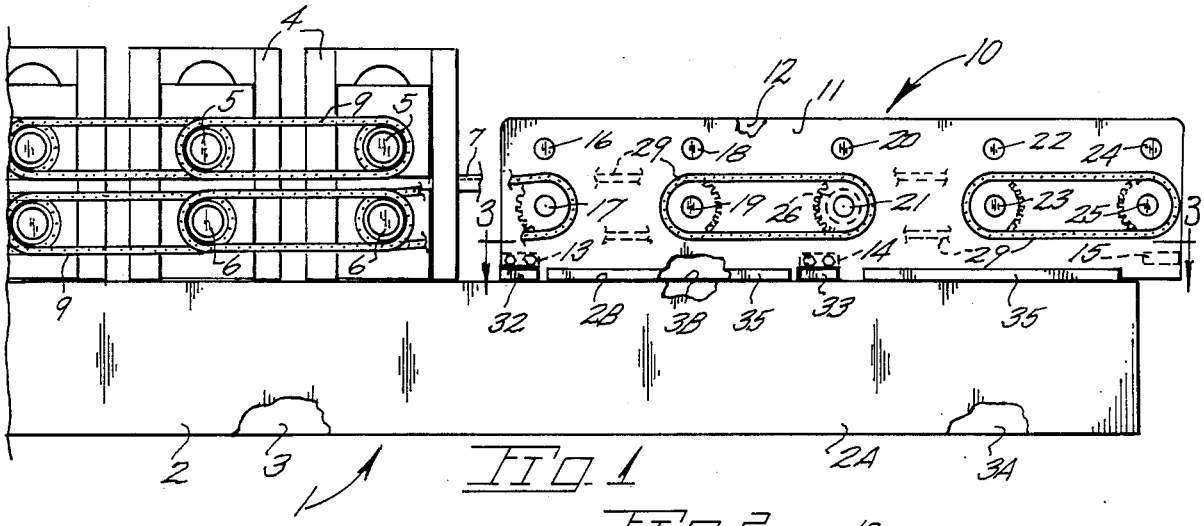
FIG. 1
FIG. 2
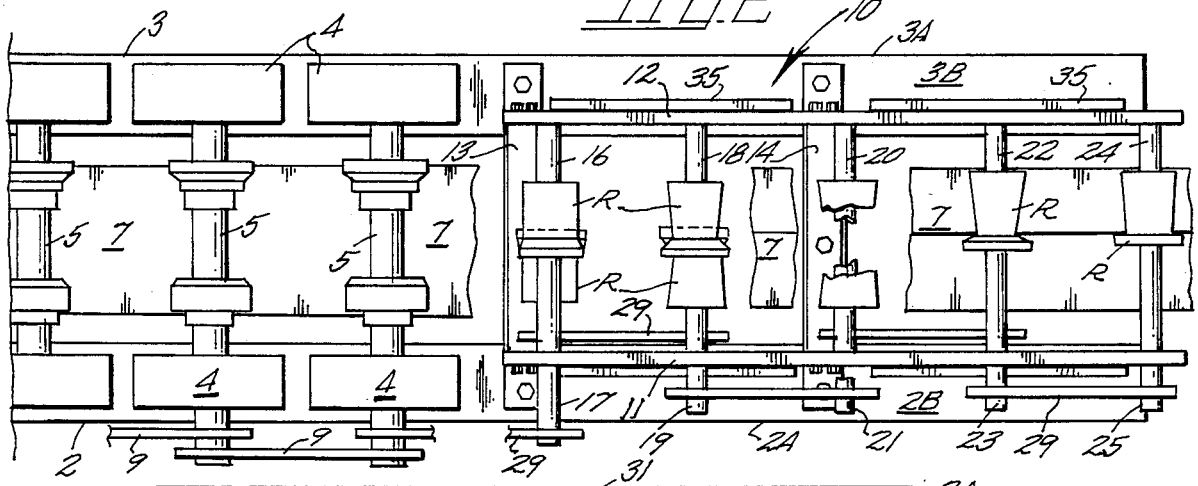
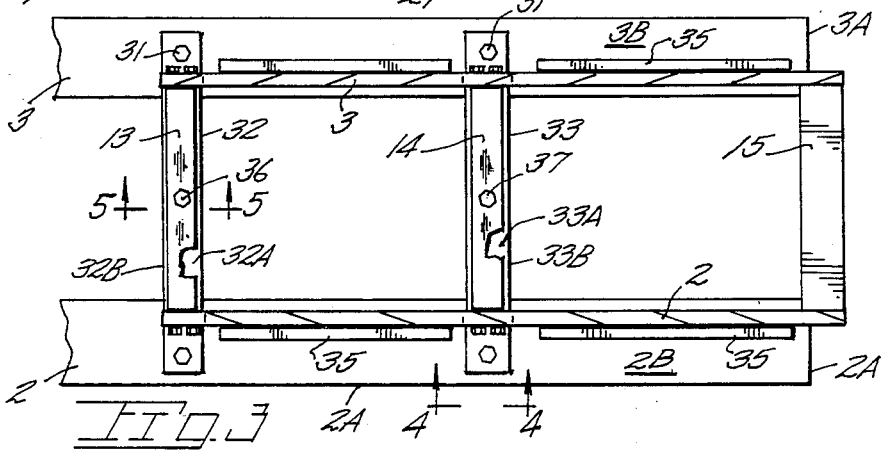
FIG. 3
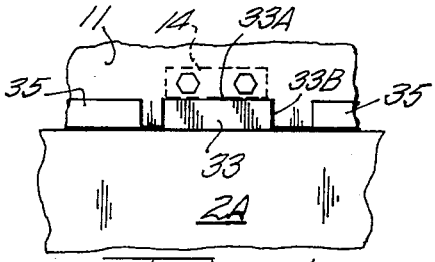
FIG. 4
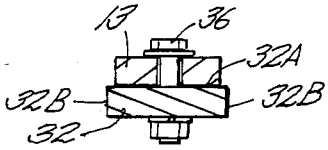
FIG. 5

ROLL FORMING MACHINE WITH AUXILIARY ROLL SET ASSEMBLY

BACKGROUND OF THE INVENTION

The present invention pertains generally to roll forming machines having a multitude of roll sets for the progressive shaping of continuous sheet metal fed between the roll sets.

U.S. Pat. Nos. 3,710,607; 3,788,155 and 4,020,666 show roll forming machines for the production of metal siding for application to the exterior of houses. A continuous metal strip is fed from a source such as a roll of such material through upper and lower roll sets to progressively impart configurations to the side margins of the material. U. S. Pat. No. 3,788,115 discloses an extension for attachment to such a machine. The extension swings about a horizontal axis into and out of an operable position at the discharge end of the roll forming machine. Such an extension enabled the optional forming of bends along the central portion of the metal strip, but had a tendency to become misaligned with the fixed roll sets of the machine. Roll alignment is critical to the production of precision made metal siding for homes. In addition to the recurring alignment problems, the extension was of bulky configuration, considerable weight, costly to fabricate and attach to the roll forming machine. Accordingly, once in place, the extension was not easily interchanged with a second extension. It is now common to impart shape to the continuous central area of the siding strip. Siding contractors heretofore offered siding with or without a shaped central area. A machine once equipped with a roll equipped extension was not easily modified by the substitution of a replacement set of auxiliary rolls.

SUMMARY OF THE PRESENT INVENTION

The present invention is embodied in a machine having a pair of side frame members adapted to detachably receive one of several auxiliary roll set assemblies in a convenient and rapid manner.

The present roll forming machine includes parallel side frame members which serve to mount several permanent roll sets which progressively impart shape to the side margins of a sheet metal siding strip driven therethrough. Roll forming machines are commonly mounted on mobile bases for convenient transport to a site whereat both the production and the application of the metal siding takes place. The frame members of the present roll forming machine support the permanently mounted roll sets and also provide supporting structure for an auxiliary roll set assembly. The auxiliary roll set assembly includes upright plate members for edgewise placement on the roll machine frame members. Roll sets of the auxiliary roll set assembly act on a central portion of the metal siding strip being formed to impart a desired shape thereto. Cross members in place on the side frame members of the roll forming machine cooperate with surfaces formed on the underside of assembly plate members to position and retain said assembly in a precise manner.

The auxiliary roll set assembly may be readily removed and a replacement roll set assembly substituted since the assembly may be set in place and secured by only a few fasteners.

Important objectives of the present machine include the provision of a roll forming machine and an auxiliary roll set assembly with the latter having side plates shaped to assure proper positioning of the assembly on the roll forming machine frame; the provision of a roll forming machine which may accommodate various auxiliary roll set assemblies in an interchangeable manner to permit the machine operator to readily modify the machine to produce a wide range of siding of various cross sectional shapes; the provision of a roll forming machine having an auxiliary roll set assembly of lightweight which permits the latter to be removed and a substitute roll set assembly installed in the field in a matter minutes with proper alignment being automatically assured; the provision of a roll forming machine with an auxiliary roll set assembly of low cost construction and of simple installation to permit a siding contractor to readily modify a roll forming machine in the field to best suit the consumer's desires.

BRIEF DESCRIPTION OF THE DRAWINGS

In the accompanying drawings:

FIG. 1 is a fragmentary side elevational view of a roll forming machine embodying the present invention;

FIG. 2 is a plan view of FIG. 1;

FIG. 3 is a horizontal sectional view taken downwardly along line 3—3 of FIG. 1;

FIG. 4 is a vertical elevational view taken along line 4—4 of FIG. 3; and FIG. 5 is a vertical sectional view taken along line 5—5 of FIG. 3.

DETAILED DESCRIPTION OF THE PREFERRED EMBODIMENTS

With continuing attention to the drawings wherein applied reference numerals indicate parts similarly hereinafter identified, the reference numeral 1 indicates the frame of a roll forming machine, said frame comprising laterally spaced, parallel members 2 and 3.

The roll machine frame members are commonly supported by a machine base (not shown) which may be part of a truck or trailer body to provide a mobile roll forming machine. Such mobile forming machines are disclosed in U.S. Pat. Nos. 3,710,607; 3,788,115 and 4,020,666 which disclosures are incorporated herein by reference.

In place on the uppermost surfaces of each machine frame member 2 and 3 are pairs of bearing supports 4 in which are journalled upper and lower roll bearing shafts 5 and 6. A continuous sheet metal strip at 7 is unreeled from a supply reel which may be carried by the unseen end of the machine frame members with the strip being drawn through the roll sets powered by a train 9 of roller chains and sprockets on roll shafts 5 and 6. The foregoing is intended to be typical of known roll forming machines used in the production of metal siding for application to the exteriors of houses. The roll sets carried by shafts 5 and 6 act on and form the marginal areas of sheet metal strips 7 to permit the strips to engage subjacent and superjacent strips in a weathertight manner.

Indicated generally at 10 is an auxiliary roll set assembly having parallel side plates 11 and 12 in place on extensions 2A–3A of the machine frame. Spacer bars at 13, 14 and 15 join the side plates. Upper and lower roll carrying shafts 16–17, 18–19, 20–21, 22–23 and 24–25 are suitably journalled at their ends in bearings as at 26 at intervals along the length of the plates. The metal shaping rolls are at R.

The roll equipped shafts of the auxiliary roll assembly are equipped with a drive train 29 driven by a continuation of a roller chain drive train of the roll forming machine which drives at least one roll shaft of each upper and lower pair of roll shafts from a motor driven roll (not shown) on the roll forming machine proper.

With attention to the side plates of the auxiliary roll set assembly, the plates lowermost edges are irregular with cut-outs therein and in which are received cross members 32 and 33 in place on extensions 2A–3A of the roll forming machine. The cross members sit in place on frame member uppermost surfaces 2B–3B and are held in place by fasteners as at 31. The cross members 32 and 33 have right angularly orientated surfaces 32A–32B and 33A–33B which are received in correspondingly shaped cut-out openings formed in the lower edge of each side plate. Fastener assemblies at 36 and 37 extend through openings 30 in the spacer bars to retain the assembly in place. Bars at 35 on the machine frame member 2 and 3 confine the plates 11 and 12 of the auxiliary roll assembly against lateral displacement.

In use, the roll forming machine is transported to the siding installation site, such as a house, and the siding rolled and cut to length. The present auxiliary roll set assembly permits the siding contractor to offer the consumer a wide range of panel configurations resulting from the particular roll configuration in the auxiliary roll set assembly selected. The compact, lightweight nature of the present roll set assembly enables the contractor to conveniently transport a number of roll set assemblies and install same on the roll forming machine at the siding production and installation site without the services of shop personnel. Heretofore the installation of auxiliary roil set entailed the tedious and precise mounting of the roll set assembly by highly skilled workmen and, accordingly, could not be performed in a practical manner in the field.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

1. An auxiliary roll set assembly for attachment in a detachable manner to the side frame members of a roll forming machine, said assembly comprising, parallel side frame member extensions spaced from one another and extending longitudinally from said side frame members, cross members superimposed on said frame members and spanning the spacing between said parallel side frame member extensions, a pair of parallel side plates spaced from one another and having lower edges for rested engagement one each with said side frame member extension, said side plates having right angularly shaped cut-out openings at intervals along said lower edges to receive said cross members in a precise manner to assure said side plates being parallel to the frame member extensions of the roll forming machine, spacer bars interconnecting said side plates at said intervals at a location above said cut-out openings, said spacer bars overlying said cross members with the cross members being received in said cut-out openings, a fastener attaching one each of said spacer bars to one each of said cross members to facilitate removal of the auxiliary roll set assembly from said side frame members and the installation of a second auxiliary roll set assembly in place, and roll sets carried by said side plates for progressively shaping continuous siding material passing through the roll sets.

* * * * *